US005926848A

United States Patent [19]

Bartholomae

[11] Patent Number: 5,926,848

[45] Date of Patent: Jul. 27, 1999

[54] SPORTS ENTHUSIAST HEADBAND

[76] Inventor: Jeanneane Bartholomae, 3843 N. Milkyway, Odessa, Tex. 79764

[21] Appl. No.: 09/034,049

[22] Filed: Mar. 3, 1998

[51] Int. Cl.[6] ..... A41D 20/00; A45D 8/00

[52] U.S. Cl. ..... 2/171; 2/209.13; 2/DIG. 11; 132/273; 132/275

[58] Field of Search ..... 2/171, 209.13, 2/DIG. 11; 132/273, 275

[56] References Cited

U.S. PATENT DOCUMENTS

| | | | |
|---|---|---|---|
| D. 273,341 | 4/1984 | Rol | 2/DIG. 11 |
| 1,287,626 | 12/1918 | Brett | 132/273 |
| 2,767,404 | 1/1956 | Collins . | |
| 4,845,783 | 7/1989 | Motley . | |
| 5,003,640 | 4/1991 | Pizzacar . | |
| 5,427,123 | 6/1995 | Odenthal | 132/275 |
| 5,493,735 | 2/1996 | Rice . | |
| 5,598,585 | 2/1997 | Stroup . | |

*Primary Examiner*—Diana L. Oleksa
*Attorney, Agent, or Firm*—Robert C. Peterson

[57] ABSTRACT

An apparel item especially for females which includes a headband having a series of metallic ribbons and cloth ribbons extending from the central region of the headband down the back of the head and over the shoulders of the wearer, the ribbons being curled and of varying lengths and are generally gathered by a barrette or clasp containing a sports team logo or other indica. The headband includes a tiara or crown piece of various artistic designs.

15 Claims, 3 Drawing Sheets

SPORTS ENTHUSIAST HEADBAND

BACKGROUND OF THE INVENTION

This invention relates to head apparel, more particularly a feminine sports enthusiast's headband having curly streamers extending from the central region down the back of the wearer's head with the streamers fastened with a clasp and the headband having a tiara or crown appearance.

The prior art has disclosed various caps, head-dress, head apparel such as caps advertising a name on them, head-dresses with veils and the like; however, such items lack attraction by feminine sports enthusiasts and are not readily adaptable to fanatical enthusiasm for sports entities.

SUMMARY OF THE INVENTION

It is an object of the present invention to provide sports enthusiasts and in particularly youth and adult females, attractive head apparel having feminine appeal in supporting sports entities of their desire.

It is another object of the invention to provide a headband having metallic and other ribbons forming curls and extending down the wearer's neck and shoulders held together at the back of the neck by a barrette with a sports entity's logo affixed thereto in which the headband includes a crown or tiara design which may include participants names or other decorative designs.

It is a further object of the invention to provide sports enthusiasts and in particularly youth and adult females, attractive head apparel having feminine appeal in supporting sports entities of their desire wherein the overall theme of the headband is to provide coordinated color schemes for the ribbons, logo and crown or tiara for the sports entity the enthusiast is supporting.

It is another object of the invention to provide female sports enthusiasts attractive head apparel including a headband of a tiara design having curly streamers of varying lengths extending rearward from the headband and at least beyond the shoulders of the wearer gathered in a pony tail array near the neck of the wearer.

DESCRIPTION OF PREFERRED EMBODIMENT

Figure 1:
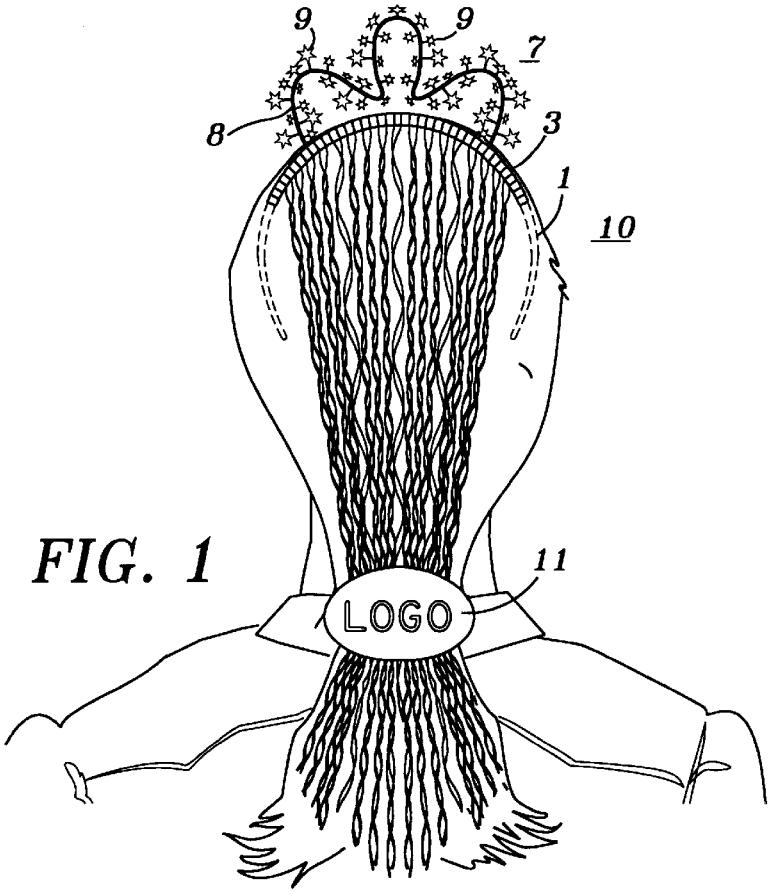
FIG. 1 illustrates the headband from the rear of the wearer featuring the ribbons, logo and crown.

Referring now to FIGS. 1 through 8, the preferred embodiment of the invention of the headband generally 10 is illustrated. In particular, FIG. 1 illustrates the completed headband 10 including band 1 which has ribbon-wrapping 2 covering approximately the crown area 3 of band 1. As illustrated in FIG. 1, the band 1 rests on the wearer's head with the unwrapped portion of band 1 covered by the wearer's hair. It should be noted for illustration, the portion of band 1 hidden by the wearer's hair is shown in broken lines.

Figure 3:
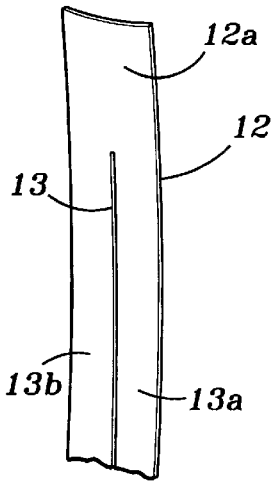
FIG. 3 illustrates the construction of the ribbon at the upper end being split to form two streamers from a single strand of ribbon.
Figure 2:
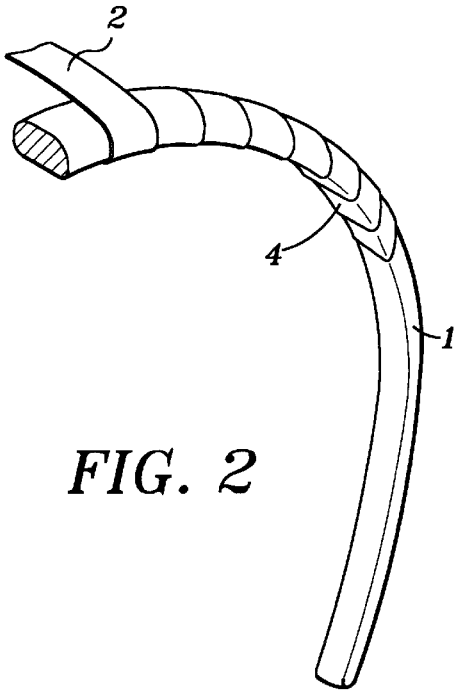
FIG. 2 shows in perspective a section of the initial wrapping of the band.
Figure 4:
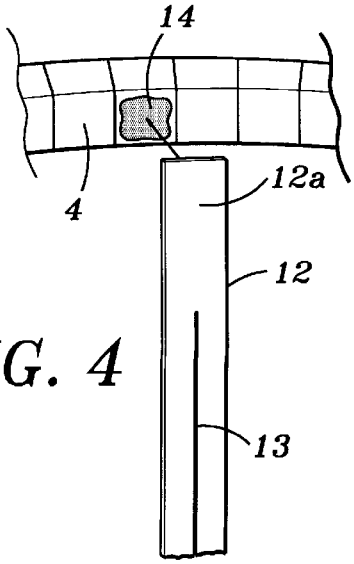
FIG. 4 is an exploded view that illustrates the attachment of ribbon of FIG. 3 to the headband in FIG. 2.

Referring now to FIGS. 3 and 4, a ribbon 12 distal from the top 12*a* is partially split as at 13 to form twin strips of ribbon 13*a* and 13*b*. The ribbon 12 at top 12*a* is attached by glue 14 on the underside 4 of the wrapping 2 on band 1.

Figure 5:
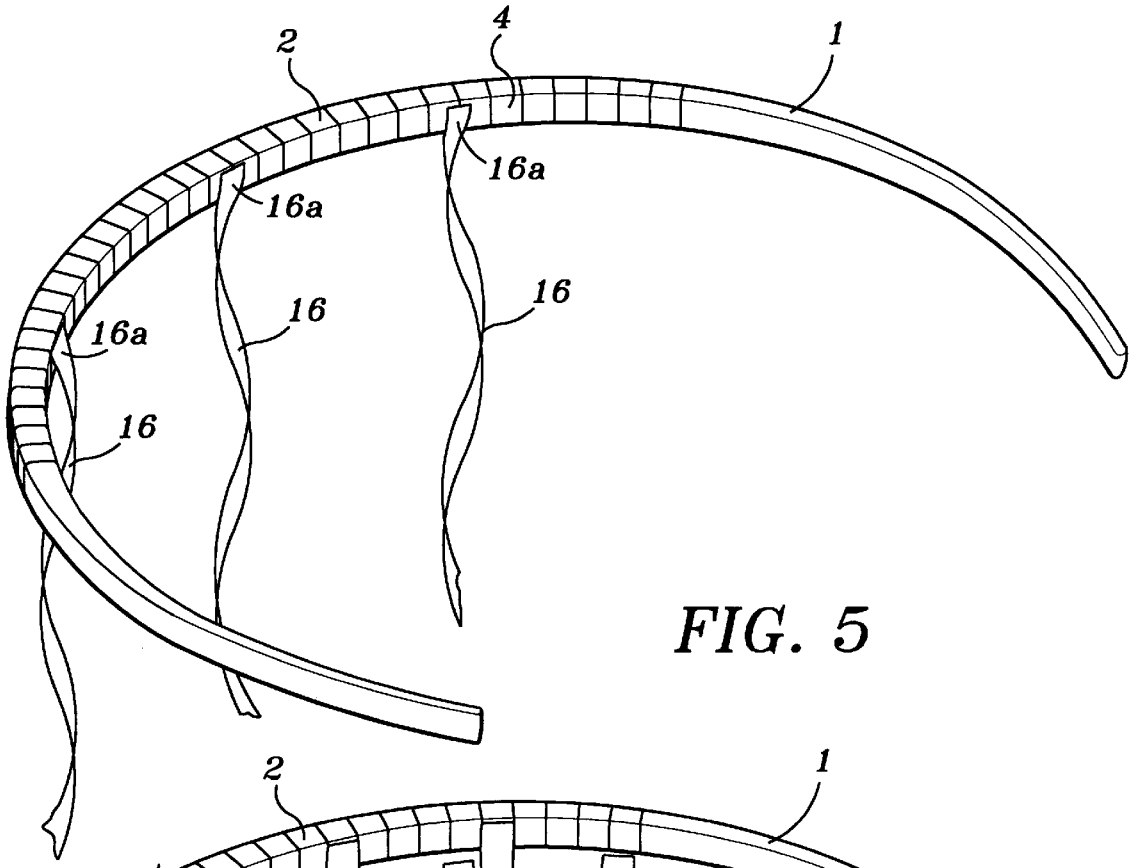
FIG. 5 illustrates the arrangement of the metallic ribbons on the wrapped headband.
Figure 6:
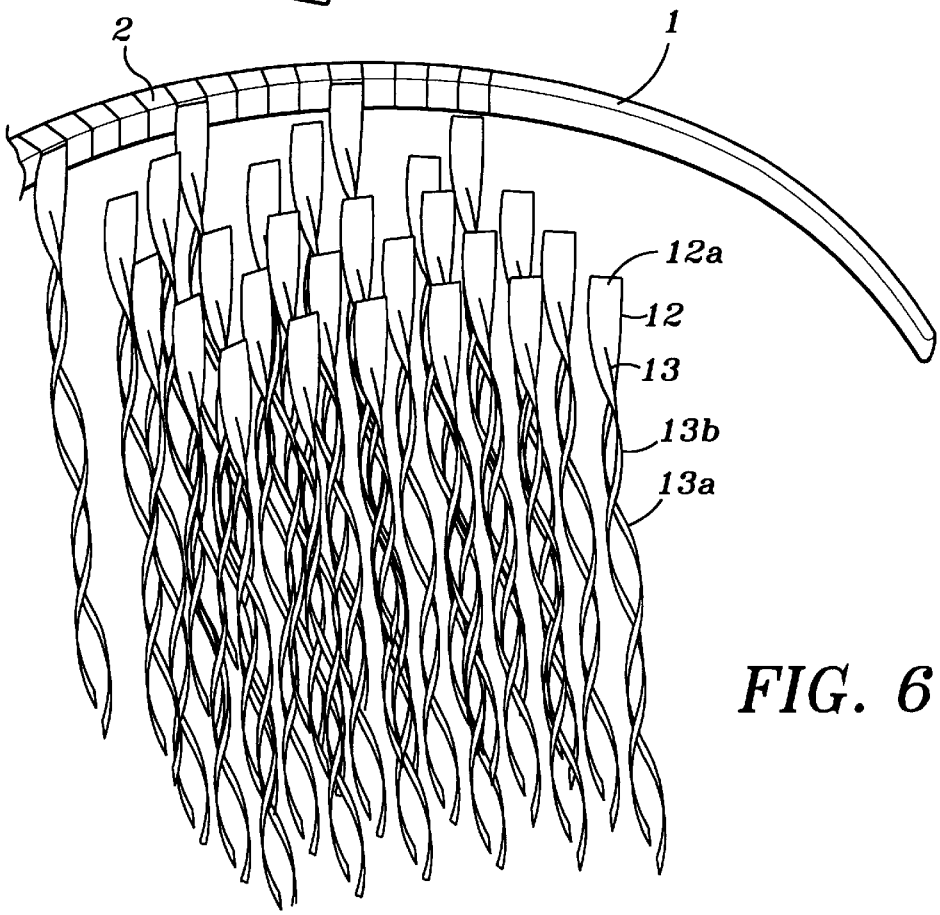
FIG. 6 illustrates in a fragmented view the attachment of the cloth or paper ribbons of varying lengths.
Figure 7:
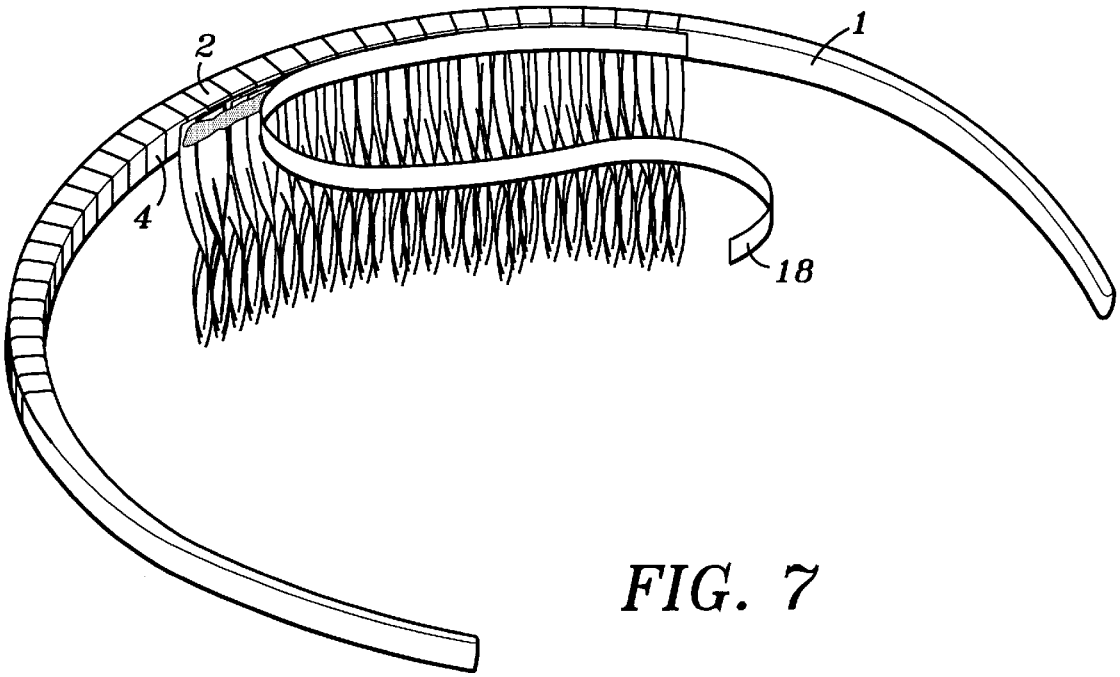
FIG. 7 illustrates the arrangement for securing all of the ribbons end together with a ribbon strip glued to the underside of the headband.
Figure 8:
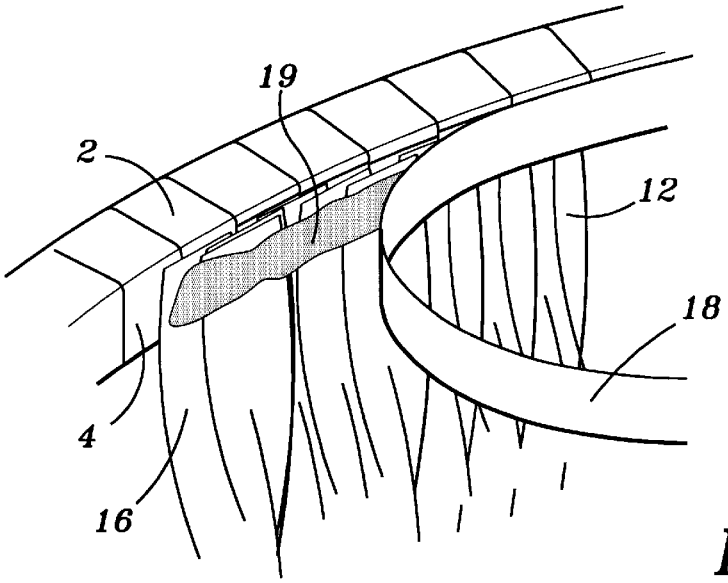
FIG. 8 illustrates a fragmented close-up view of the headband in FIG. 7.

Referring further to FIGS. 5 and 6, solid strips of metallic ribbon 16 are attached to underside 4 of band 1 uniformly spaced about the wrapping 2 of band 1. Specifically, in FIG. 6 which for simplicity illustrates the attachment of ribbon 12 to the wrapping 2 of band 1 only for half of the entire headband 10. The ribbons 12 in FIG. 6 are numbered for convenience as to their length in feet. The varying lengths of ribbon 12 are distributed uniformly along the underside 4 of wrapping 2 on band 1. The ribbons 12 are all glued as illustrated in FIG. 4 to the underside 4 of wrapping 2 of band 1. In order to further secure the ribbons 12 and metallic ribbons 16 in place reference is made to FIGS. 7 and 8. The ribbons 12 and 16 are held in place by ribbon strip 18 which is affixed by glue 19 extending across the top 12*a* and 16*a* of ribbons 12 and 16 respectively, along the underside 4 of wrapping 2 on band 1. Thus, the individual ribbons 12 and 16 are further bound to the underside 4 of wrapping 2 on band 1 by ribbon strip 18 and glue 19.

Secured atop the wrapping 2 of band 1 is a crown piece generally referred to as 7 which may be in the form of a tiara 8 adorned with stars 9, the crown piece 7 would be secured in any suitable manner.

A typical headband 10 would have a width of approximately ¼ inch. The band 1 with ribbon wrapping 2 extending over the central span 3 of band 1 covers approximately ⅓ of band 1. The outer two of the metallic ribbons 16 are three feet in length and the center metallic ribbon 16 is two feet in length. The ribbons 12 consist of six ribbons one foot in length, six ribbons one and one-half feet in length, six ribbons two feet in length, nine ribbons two and one-half feet in length, nine ribbons three feet in length and nine ribbons three and one-half feet in length. The split ribbons 12 are uncut approximately ½ inch at the top 12*a*. The ribbons 12 are 3/16th inch in width before being split. The barrette 11 is approximately a two inch wide oval bearing a team logo or other indicia. The tiara 8 typically is made of metallic garland being twelve inches in length. The logo 11 may be placed as part of the crown piece with the barrette 11 having a player's name or other team emblem. Likewise, a player's name or team emblem could be placed on the crown piece. For example, if the particular team colors are red and blue, the ribbons 12 would be one-half blue and one-half red, and color coordinated with the crown piece 7 and the barrette 11. The different color ribbons 12 would be interspersed.

It will be understood that the color scheme of the ribbons and the logo would be coordinated to the color scheme of the sports entity being supported. The crown piece 7 may be of other aesthetic decorations appealing to feminine taste may be coordinated to the overall color scheme of the sports entity.

What is claimed is:

1. An item of head apparel for feminine persons comprising:

(i) an arcuate headband with a central span spiral wrapped with ribbon for bridging the pate of a wearer;

(ii) a profusion of ribbons secured to the central span of the headband extending rearward and gathered in a pony tail array; and (iii) a crown piece of aesthetic adornment secured to the headband and extending upward therefrom.

2. An item of head apparel for feminine persons comprising:

(i) a headband of flexible material including a central span, having a relatively flat underside and semi-elliptical upper contour for bridging the pate of a wearer;

(ii) a strip of material wrapped around the central span of the headband;

(iii) a series of spaced curled metallic ribbons secured to the strip of material on the underside of the headband;

(iv) a profusion of curled ribbons secured to the strip of material on the underside of the headband and adapted to extend therefrom at least a sufficient length to extend beyond the shoulders of a wearer; and (v) a crown piece of aesthetic adornment extending outward from the central span of the headband.

3. The item of head apparel in claim 2 wherein a clip retains the metallic ribbons and curled ribbons in a pony tail array adapted to be worn at the neck region of a wearer.

4. The item of head apparel in claim 3 wherein the profusion of curled ribbons are equally of at least two distinct colors.

5. The item of head apparel of claim 4 wherein the distinct colors are coordinated with the colors of the logo and the crown piece.

6. Decorative head apparel for feminine persons comprising:

(i) a headband of flexible plastic material in an arch-shape form including a central span being about one-third of the entire headband, the band being contoured to the pate of a wearer;

(ii) a narrow strip of material spirally wrapped about the central span of the headband;

(iii) a series of curled metallic ribbon spaced along the underside of the strip of material at the underside of the central span and adapted to extend at least below the neck of a wearer;

(iv) a profusion of curled ribbons secured to the strip of material at the underside of the central span and adapted to extend at least to the shoulders of a wearer; and (v) a crown piece in the shape of a tiara extending upward from the central span of the headband, said crown piece adorned with aesthetic designs.

7. The decorative head apparel of claim 6 wherein the metallic ribbons and the profusion of curled ribbons are gathered together in a pony tail array.

8. The decorative head apparel of claim 7 wherein the metallic ribbons and curled ribbons are gathered with a clip.

9. The decorative head apparel of claim 8 wherein the clip bears indicia.

10. The decorative had apparel of claim 9 wherein the clip bears a team logo.

11. The decorative head apparel of claim 7 wherein the profusion of curled ribbons are equally of at least two distinct colors.

12. The decorative head apparel of claim 11 wherein the distinct colors are coordinated with the colors of the logo and the crown piece.

13. The decorative head apparel of claim 6 wherein the profusion of curled ribbons contains at least 45 bifurcated strands.

14. The decorative head apparel of claim 13 wherein bifurcated strands are of varying length.

15. The decorative head apparel of claim 14 wherein the varying lengths are from one foot in half-foot increments to three and one-half feet.

* * * * *